US009857154B2

(12) United States Patent
Minnicino, II

(10) Patent No.: US 9,857,154 B2
(45) Date of Patent: Jan. 2, 2018

(54) STEERABLE MUNITIONS PROJECTILE

(71) Applicant: U.S. Army Research Laboratory ATTN: RDRL-LOC-1, Adelphi, MD (US)

(72) Inventor: Michael A. Minnicino, II, Baltimore, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/446,377

(22) Filed: Jul. 30, 2014

(65) Prior Publication Data

US 2016/0033244 A1 Feb. 4, 2016

(51) Int. Cl.
*F42B 12/02* (2006.01)
*F42B 10/62* (2006.01)

(52) U.S. Cl.
CPC ..... *F42B 12/02* (2013.01); *F42B 10/62* (2013.01)

(58) Field of Classification Search
CPC .... F42B 8/00; F42B 8/12; F42B 10/00; F42B 10/02; F42B 10/025; F42B 10/26; F42B 10/32; F42B 10/34; F42B 10/38; F42B 10/48; F42B 10/52; F42B 10/60; F42B 10/62; F42B 12/00; F42B 15/00; F42B 15/01; F42B 15/10; F42B 25/00; F42B 30/00; F42B 30/08; F42B 30/10
USPC ..... 102/501, 502, 503, 506, 507, 508, 511, 102/513, 514, 517, 529; 244/3.1, 3.23
See application file for complete search history.

(56) References Cited

U.S. PATENT DOCUMENTS 3,282,214 A * 11/1966 Briscoe ..... F42B 12/34 102/376
3,949,677 A * 4/1976 Voss ..... F42B 30/02 102/501
5,139,215 A * 8/1992 Peckham ..... F42B 10/04 244/206
5,139,216 A * 8/1992 Larkin ..... F42B 10/62 244/3.1
5,788,178 A * 8/1998 Barrett, Jr. ..... F41G 7/226 102/501
6,012,393 A * 1/2000 Tal ..... F42B 12/06 102/374

(Continued)

FOREIGN PATENT DOCUMENTS

DE 10 2005 043 474 A1 * 3/2007 ..... F42B 10/62

*Primary Examiner* — Bret Hayes
(74) *Attorney, Agent, or Firm* — Alan I. Kalb

(57) ABSTRACT

A munition having a warhead and an ogive coaxially rotatably mounted to the warhead. A controllable motor is mechanically coupled to the ogive to control the rotational position of the ogive relative to the warhead. The ogive includes an asymmetric surface while a windscreen is detachably connected to the ogive over the asymmetric surface so that, with the windscreen attached to the ogive, the outer surface of the ogive together with the windscreen are axisymmetric in shape. A detachment mechanism, when activated, detaches the windscreen from the ogive which permits steering of the munition by placement of the asymmetric surface relative to the warhead. The introduction of the asymmetric surface during flight produces an asymmetric pressure field resulting in a lateral force on the munition causing is to change direction.

2 Claims, 1 Drawing Sheet

(56) References Cited

U.S. PATENT DOCUMENTS

| | | | | |
|---|---|---|---|---|
| 8,466,397 | B1 * | 6/2013 | Teter | F42B 10/62<br>102/384 |
| 2005/0000383 | A1 * | 1/2005 | Facciano | F42B 10/46<br>102/377 |
| 2007/0074636 | A1 * | 4/2007 | Rieger | F42B 10/46<br>102/378 |
| 2008/0237391 | A1 * | 10/2008 | Mock | F42B 10/26<br>244/3.1 |
| 2011/0101154 | A1 * | 5/2011 | Mallon | F42B 10/46<br>244/3.11 |
| 2011/0192308 | A1 * | 8/2011 | Fisch | F42B 15/36<br>102/377 |

* cited by examiner

STEERABLE MUNITIONS PROJECTILE

GOVERNMENT INTEREST

The invention described herein may be manufactured, used, and licensed by or for the United States Government.

BACKGROUND OF THE INVENTION

I. Field of the Invention

The present invention relates to munitions and, more particularly, to a projectile which is steerable after launch.

II. Description of Relevant Art

There are many previously known projectiles used in military applications in which a warhead is coaxially mounted to an ogive and launched through a gun tube. In many cases, the gun tube is rifled so that the projectile spins around its longitudinal axis as the projectile exits the gun tube. Such a spin stabilizes the projectile to minimize, or altogether eliminate, tumbling of the projectile after launch.

Some of these previously known projectiles, such as the projectiles launched from large bore gun tubes, may travel over a range of 10 miles or more. Many smart projectiles, projectiles that either have the ability to change their trajectory utilize fins to maneuver. These fins are often supercaliber meaning that the fins span a diameter greater than the bore diameter of the gun the projectile was shot from. These supercaliber fins are therefore required to be stowed in a subcaliber configuration during gun launch and are deployed sometime after exiting the gun. The deployment of the supercaliber fins requires additional hardware, complexity, and cost.

SUMMARY OF THE PRESENT INVENTION

The present invention provides a munitions projectile which overcomes the above mentioned disadvantages of the previously known smart projectiles.

In brief, the projectile of the present invention comprises a warhead having an ogive coaxially rotataby mounted to the forward end of the warhead. A controllable motor is then mechanically coupled to the ogive to control the rotational position of the ogive relative to the warhead either in a steady state or intermittent basis.

The ogive includes an asymmetric surface, such as a planar surface. A windscreen is then detachably connected to the ogive so that the windscreen covers the asymmetric surface on the ogive and, with the windscreen attached to the ogive, the outer surface of the ogive together with the windscreen is axisymmetric.

In the event that it is necessary to steer the projectile after launch, the projectile sheds the windscreen thus exposing the asymmetric surface. The motor then controls the relative rotation between the ogive and the warhead, either on a continuous or intermittent basis, to place the asymmetrical surface in a desired rotational position relative to the warhead. This, in effect, steers the projectile in a desired direction toward the target.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figures 1, 2, 3:
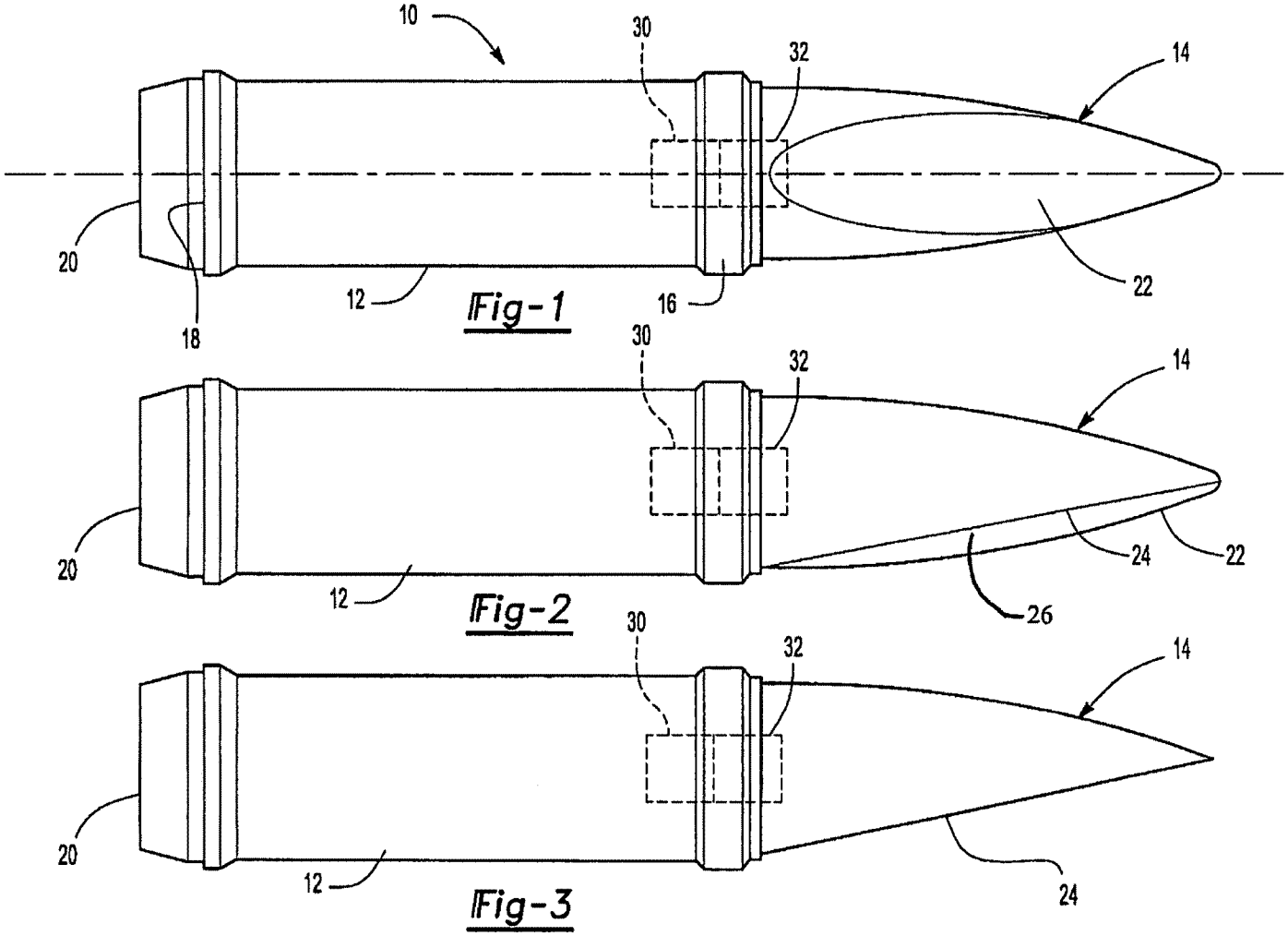
FIG. 1 is a side view illustrating a preferred embodiment of the projectile of the present invention.
FIG. 2 is a top view illustrating the preferred embodiment of the projectile of the present invention.
FIG. 3 is a view similar to FIG. 2, but illustrating the projectile after the windscreen has been shed.

With reference first to FIGS. 1 and 2, a projectile 10 in accordance with the present invention is shown. The projectile 10 includes a generally cylindrical warhead 12 coaxially aligned with an ogive 14 at its forward end. The ogive 14 and warhead 12, furthermore, are rotatably mounted relative to each other by any conventional rotatable mounting mechanism.

An obturation band 18 is provided around the warhead 12 adjacent its rear end 20. The obturation hand obturates the launch gas for maximum acceleration and velocity of the projectile 10. The obturation band also cooperates with the gun rifling (not shown) to spin the projectile 10 upon launch. The obturation band may be one of two types depending on the desired spin behavior of the projectile. A fully spun projectile spins about its longitudinal axis at a rate determined by the kinematic constraint between the projectile's linear velocity and the gun rifling. A despun projectile spins at a rate much less than the full spin rate. A fully spun, spin stabilized projectile's obturation band is referred to as at a rotation band and it is fixed to the warhead. A despun, fin-stabilized projectile's obturation band is referred to as a slip band and allows relative rotational motion between itself and the warhead. Additionally, the warhead 12 and ogive 14 are preferably locked against rotation during gun launch so that there is no relative rotation.

With reference now particularly to FIGS. 1-3, the ogive 14 includes an asymmetric surface 24. This asymmetric surface 24 is illustrated as a planar surface in the drawing but other types of asymmetric surfaces may be used without deviation from the spirit or scope of the present invention provided, of course, that the asymmetric surface 24 is asymmetric with respect to the remainder of the projectile's axisymmetric axis.

With reference now to FIGS. 1 and 2, a windscreen 22 is detachably secured to the ogive 14 over the asymmetric surface 24. The windscreen 22 has an exterior shape such that, with the windscreen 22 attached to the ogive 14, the outer surface of the ogive 14 together with the windscreen 22 is axisymmetric in shape.

A detachment mechanism is used to detachably secure the windscreen 22 to the ogive 14. For example, a reactive film (not shown) may be applied onto and therefore conformal with the asymmetric surface 24 and is therefore positioned at the shared interface between the windscreen 22 and the ogive 14. The reactive film in combination with an adhesive may be used to adhesively secure the windscreen 22 to the ogive 14. The sacrificial reactive film, however, once activated is self-consuming which causes complete separation of the windscreen 22 from the ogive 14.

With reference now particularly to FIG. 1, the projectile 10 includes a controller as well as a controllable motor, such as DC controllable motor, shown as a combined controller-motor unit 30. The controller-motor unit receives commands, for example, from the guidance and navigation unit. In response to those command signals, the controller-motor unit 30 generates output signals to activate the reactive film upon receipt of the appropriate command, as well as control the rotational position of the ogive 14 relative to the warhead 12 by selectively activating the controllable motor of the controller-motor unit 30.

For example, if after launch of the projectile 10 it is determined that the projectile 10 may be steered in a leftward direction, the projectile is required to she the windscreen 22. The controller-motor unit 30 sheds the windscreen 22 by activating the reactive film whereupon the windscreen 22 separates from the projectile 10.

The controller-motor unit 30 then generates control signals to the controllable motor to rotatably position the asymmetric surface 24 on the right side of the projectile 10. In doing so, the asymmetric surface 24 provides an asymmetric pressure field causing the projectile 10 to steer in a leftward direction toward the desired target.

The positioning of the asymmetric surface 24 in the proper position to achieve the desired steering of the projectile 10 may be either continuous or intermittent. For example, in a continuous operational mode, the controller-motor unit 30 may activate the controllable motor at a rotational speed relative to the warhead 12 so that the asymmetric surface 24 remains in a stationary rotational position. Conversely, the control of the motor by the controller-motor unit 30 may be intermittent in which the asymmetric surface 24 is effectively momentarily stopped for each revolution of the projectile 10 at the rotational position of the ogive 14 necessary to obtain the desired steering of the projectile 10. This momentary halt or dwell of the ogive rotation per rotation of the projectile 10 will effectively position the asymmetric surface 24 in a particular rotational position for a more extended period of time than the other rotational positions of the ogive 14. The momentary halt of the asymmetric surface 24 at the desired rotational position results in the incremental steering of the projectile toward the target.

From the foregoing, it can be seen that the projectile of the present invention provides a simple, yet effective, steerable projectile for long range munitions. Having described my invention, however, many modifications thereto will become apparent to those skilled in the art to which it pertains without deviation from the spirit of the invention as defined by the scope of the appended claims.

I claim:

1. A projectile comprising:

a warhead, an ogive coaxially rotatably mounted to said warhead, a controllable motor mechanically coupled to said ogive to control a rotational position of said ogive relative to said warhead, said ogive having an asymmetric surface, a windscreen detachably connected to said ogive over said asymmetric surface so that, with said windscreen attached to said ogive, an outer surface of said ogive together with said windscreen is axisymmetric, a detachment mechanism which, when activated, detaches said windscreen from said ogive, and wherein said warhead spins in one rotational direction and said motor rotatably drives said ogive in the opposite rotational direction and wherein said detachment mechanism comprises a reactive film between said ogive and said windscreen which, when activated, is self-consuming, and further comprising a controller-motor unit which controls the motor's shaft speed or position of said motor.

2. The projectile as defined in claim 1 wherein said controller-motor unit is able to control a motor shaft speed or position of said motor in a continuous or an intermittent basis.

* * * * *